US008210366B2

(12) United States Patent
Kahn

(10) Patent No.: US 8,210,366 B2
(45) Date of Patent: Jul. 3, 2012

(54) UNIVERSAL SPORT BOARD RACK

(76) Inventor: Dennis Kahn, Santa Monica, CA (US)

( * ) Notice: Subject to any disclaimer, the term of this patent is extended or adjusted under 35 U.S.C. 154(b) by 0 days.

(21) Appl. No.: 13/248,663

(22) Filed: Sep. 29, 2011

(65) Prior Publication Data

US 2012/0018394 A1 Jan. 26, 2012

Related U.S. Application Data

(63) Continuation of application No. 12/631,646, filed on Dec. 4, 2009, now abandoned, which is a continuation of application No. 11/938,160, filed on Dec. 29, 2007, now abandoned, which is a continuation of application No. 10/960,186, filed on Oct. 6, 2004, now abandoned.

(60) Provisional application No. 60/508,303, filed on Oct. 6, 2003.

(51) Int. Cl.
*A47F 7/00* (2006.01)

(52) U.S. Cl. ..... 211/85.7; 211/70.5; 211/106.01

(58) Field of Classification Search ..... 211/182, 211/85.7, 70.5, 87.01, 16, 88.04, 119.004, 211/177, 178, 123, 175, 105.1, 106.1, 124, 211/60.1, 43, 41.14, 10, 193; 248/220.31, 248/218.1, 301, 303, 682, 690, 692, 441.1, 248/447.1, 475.1, 65

See application file for complete search history.

(56) References Cited

U.S. PATENT DOCUMENTS

| | | | | |
|---|---|---|---|---|
| 3,164,256 | A * | 1/1965 | Bennett | 211/70.5 |
| 4,077,554 | A * | 3/1978 | Goode | 224/559 |
| 4,078,708 | A * | 3/1978 | Mayer | 224/509 |
| 4,234,112 | A * | 11/1980 | Gallant | 224/559 |
| 4,785,980 | A * | 11/1988 | Redick | 224/535 |
| 5,316,155 | A * | 5/1994 | Collins et al. | 211/70.5 |
| 5,465,883 | A * | 11/1995 | Woodward | 224/495 |
| 5,477,968 | A * | 12/1995 | Largent et al. | 211/60.1 |
| 5,752,638 | A * | 5/1998 | Meeks | 224/547 |
| 6,145,674 | A * | 11/2000 | Spearman et al. | 211/59.1 |
| 6,164,508 | A * | 12/2000 | van Veenen | 224/509 |
| 6,457,619 | B1 * | 10/2002 | Werner et al. | 224/405 |
| 6,591,988 | B2 * | 7/2003 | Trpkovski | 206/454 |
| 6,863,199 | B2 * | 3/2005 | Child | 224/408 |
| 6,886,791 | B2 * | 5/2005 | Dettorre | 248/201 |
| 7,143,901 | B1 * | 12/2006 | Groves | 211/41.14 |
| 2003/0062328 | A1 * | 4/2003 | Millard | 211/85.7 |

* cited by examiner

*Primary Examiner* — Jennifer E. Novosad
(74) *Attorney, Agent, or Firm* — David S. Nagy

(57) ABSTRACT

A rack for storing and displaying surfboards, sail boards and other kinds of sport boards and sporting equipment. The rack is conveniently though not necessarily wall-mountable, and can also support an additional system for the hanging, drying, storage and display of wet suits and other dampened gear.

3 Claims, 11 Drawing Sheets

FIG 13
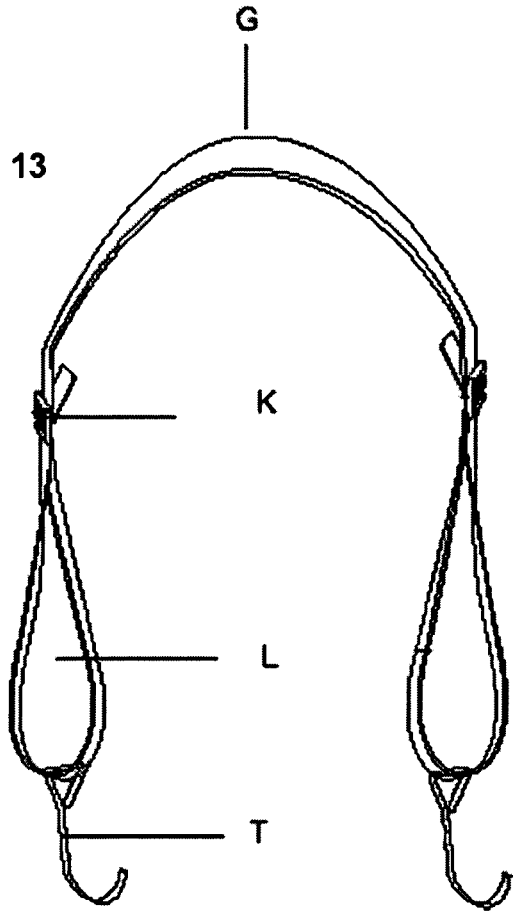
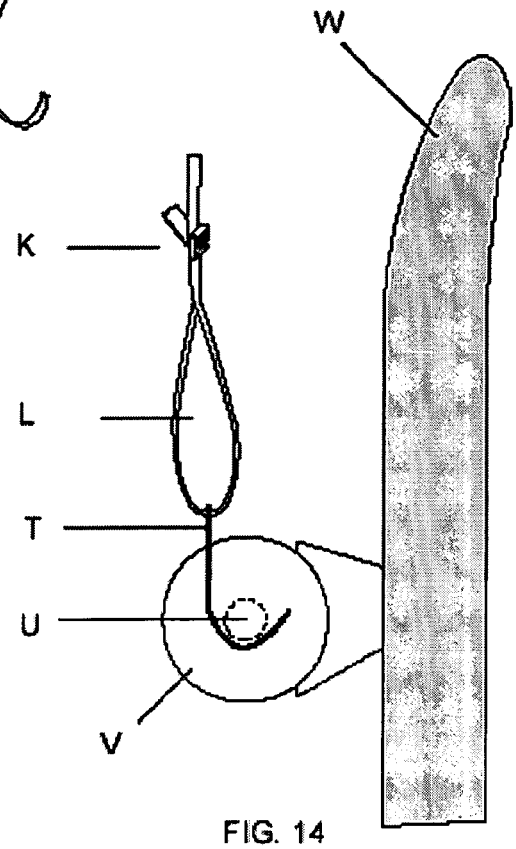
FIG. 14

UNIVERSAL SPORT BOARD RACK

CROSS-REFERENCE TO RELATED APPLICATIONS

This Application is a Continuation of application Ser. No. 12/631,646, filed Dec. 4, 2009 now abandoned, which is a Continuation of application Ser. No. 11/938,160, filed Dec. 29, 2007 now abandoned, which is itself a Continuation of application Ser. No. 10/960,186, filed Oct. 6, 2004 now abandoned, which in turn claims priority from Provisional Application No. 60/508,303, filed Oct. 6, 2003, all by the same inventor, and the disclosures of those parent applications are hereby incorporated by reference.

FIELD OF THE INVENTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention.

The preferred embodiment of this invention relates to wall storage and display hangers for recreational sport boards and, in particular, to an improved UNIVERSAL HANGING SYSTEM for the purpose of hanging all types of sporting goods, and their accessories as well as home products for interior and/or exterior storage and display.

More specifically, this invention relates to certain new and useful improvements in J-shaped wall storage hangers with an improved load carrying capacity and various interchangeable parts that allow for the storage and display of a wide assortment of items including "sport-boards" and the accessories that go with them. These items include, by way of example, surfboards, sail boards, wind surfers, wakeboards, snowboards, skateboards, earth boards, down-hill mountain boards, skis, street-luges, "X-TREME STYLE" boards, leisure boards of all types, canoes, kayaks, outriggers, very small recreational boats, fishing rods, inline skates and bicycles, as well as wine, CD's, plants, guitars and other goods used for display and storage where an improved UNIVERSAL HANGING SYSTEM is desirable.

This system can be hung in a variety of positions either in single units or pairs with the capacity to carry single and/or multiple objects in a wide variety of different combinations of similar or different types of sport boards and their accessories.

DESCRIPTION OF RELATED ART

With the advancements of technology there are new sporting goods being developed all the time. With these new developments are new discoveries and improvements on the different styles, shapes and types of recreational and professional "sport boards" as well as the accessories that go with each different sport. As an example, kite boards have modified parachutes; sailboards have masts, sails and booms, some require life vests, and most of the water "sport boards" also have wetsuits, booties, helmets. Also, there are interchangeable boots for snowboards, paddles for canoes, kayaks and outriggers and in general any accessory that is available for today's extreme sports.

With this explosion of new "fun boards" and the multitude of accessories there is a functional need for storage and/or display in the home, garage or commercial space. And most enthusiasts own several different types of boards to accommodate the different seasons and/or different preferences of several people living under the same roof.

The preferred embodiment of the UNIVERSAL HANGING SYSTEM and its removable components allows for a more diverse storage and/or display solution that is an improvement over existing wall storage hangers.

Many of the existing "sport board" and similar racks and storage systems are independently specific to each sport and its particular "board" or object, which requires an individual with two or more different sport boards to purchase several different types of storage systems to accommodate all the different sporting goods. There is no UNIVERSAL HANGING SYSTEM that can accommodate all the different types of "sport boards" that exist on the market.

Bicycles have hangers that don't fit snowboards or accommodate skis. Many of the hangers cannot fit multiple boards together. There are many different types of individual hangers that are typically designed for the bigger boards, and they permit little or no adjustment for the smaller X-treme boards, thereby using up too much space, and there is also generally little attention paid to the aesthetics of the storage rack. Furthermore, very few if any examples of the prior art also offer the advantage of storing the accessories and component gear that comes with the "sport boards" in an easy "all-in-one" solution.

Other drawbacks to the prior rack systems are wall clearances. Most of the "surfboard" racks are designed so that the board sits at a 45-degree angle from the horizontal or is laid out on a flat plane any where from 14 to 24 inches facing out from the wall, which creates a hazard for people walking into the apparatus and potentially injuring themselves as well as the board. The improved embodiment herein protrudes much less (less than 14 inches) from the wall, thereby creating a safer horizontal profile and making it a safer system than existing racks.

The improvements of this preferred embodiment allow for (1) a larger load carrying capacity, (2) a variety of different installation positions to accommodate different items for a more flexible and cooperative storage solution, (3) the ability to combine several boards of the same kind or a mixture of different boards of different kinds, (4) add on parts (i.e. the "gear straps", "skateboard strap" and Wetsuit Sling™) that add further value and convenience for added storage capacity of the different types of accessories that come with the boards, thereby enhancing capacity and allowing for an all-in-one solution, (5) a more shallow profile from the wall allowing for a safer venue for storage, (6) padding to protect the stored objects (7) a single storage solution for many items in one convenient location and (8) a more visually stunning appearance for better integration in the home, garage or commercial space.

Most of the existing wall storage hangers cannot accommodate all the improvements stated above. They are usually limited to one type of board, and those that claim the ability to store several boards have no provisions for the accessories such as the sails, kites, paddles, masts, booms and wetsuits. Some are too big and bulky creating a safety hazard. Others that are small-profiled are limited in weight-bearing capacity, usually limiting the storage just to one single type of board. None provides for any accommodations for the boards accessories, and few if any create a single flexible universal storage solution.

Some attempts have been made at wall storage for various types of boards. None has solved the problem of providing a simple, inexpensive multi-purpose wall storage hanger for hanging one or more sport boards and the various sporting equipment and/or gear that comes with them.

U.S. Pat. No. 5,833,079, issued Nov. 10, 1998 to Roberts, shows a surfboard (snowboard, skateboard, wakeboard, water ski, and snow ski) rack having two spaced-apart wall-mounted bases each having two outwardly angled pegs attached for holding two boards. While allowing for two types of boards, there are no removable "gear straps" to accommodate the different accessories such as boots, sails, masts, parachutes, paddles, helmets and life jackets that come with sailboards and kite boards. There is no "Wetsuit Sling™" to accommodate a wetsuit. Because of the almost horizontal angle there is no small profile and the boards stick out too far from the wall, creating a potential pedestrian hazard.

U.S. Pat. No. 20020190169, issued Dec. 19, 2001 to Dettorre, may have a shallow, safer profile and allows for more than one board of certain kinds, specifically those with thin rails, but the pair of U shaped spaced hooks is not wide enough to accommodate the thicker sport-boards like sailboards, wind surfers, kite boards, rafts, kayaks and outriggers. While it does have an additional looped strap with a clip-in feature, it is limited in design to carrying only the boards. It has no features to store the other accessories or gear, especially a wetsuit, and is limited in its scope to only one position of installation on a horizontal plane because it requires a long attaching wall rail. The wall rail lacks the feature of allowing storage at different angles for more flexibility and other potential storage solutions. The design also has a limitation in weight load and carrying capacity.

U.S. Pat. No. 5,082,123, issued Jan. 21, 1992 to Lamb, shows a pair of wall-mounted brackets for surfboards or sailboards, as well as bicycles and other sports apparatus. While the brackets are similar in shape, they are oriented to single objects and lack the features necessary for hanging a multiplicity of boards and their accessories. It, too, is missing the "Wetsuit Sling™" to accommodate a wetsuit and "gear straps" for the other equipment that comes with other sporting goods; also, there is no padding provided for the protection of the boards.

U.S. Pat. No. 4,878,585, issued Nov. 7, 1989 to Orestano, is a singular arrangement that utilizes straps as a major component for its storage fixture and it does not have the features necessary for multiple boards, or the flexibility of multiple storage configurations. It also fails at providing storage for the accessories that come with the different boards and is missing any component for storing a wetsuit.

None of the patents found provides a wall-mounted hanging system with all the components in one system necessary to provide the ability to store as much in the least amount of space in the safest possible way. None of the prior art offers, as this invention does, multiple configurations while providing adequate protection for the different styles of boards and the included storage of their accessories and multi-component gear.

DESCRIPTION OF THE DRAWINGS

The present invention and other details of this invention will be described in connection with the accompanying drawings, together with further embodiments and advantages, which may best be understood by reference to the following illustrations and not in limitation of the invention by the accompanying drawings of which:

FIG. 13 is a perspective view of a forth removable and adjustable component referred to as the "skateboard strap" (Y), configured of a single adjustable strapping with a loop (Z) at each end with slide-type strap adjuster mechanisms (K) and thru each loop is a small free swinging hook (T) that is used for the purpose of hanging other objects such as skateboards, mountain boards, fishing rods and other smaller type of objects. The "Skateboard Strap" hangs in the curve of the improved J-shaped hook either in front of or behind any board that is sharing the same resting space.

FIG. 14 is a side perspective view of the wheel (V) and axle (U) of a skateboard (W) hanging inside the curved section of the hook (T) that is attached to the loop (Z) of the "Skateboard Strap".

DETAILED DESCRIPTION OF THE INVENTION

Figure 1:
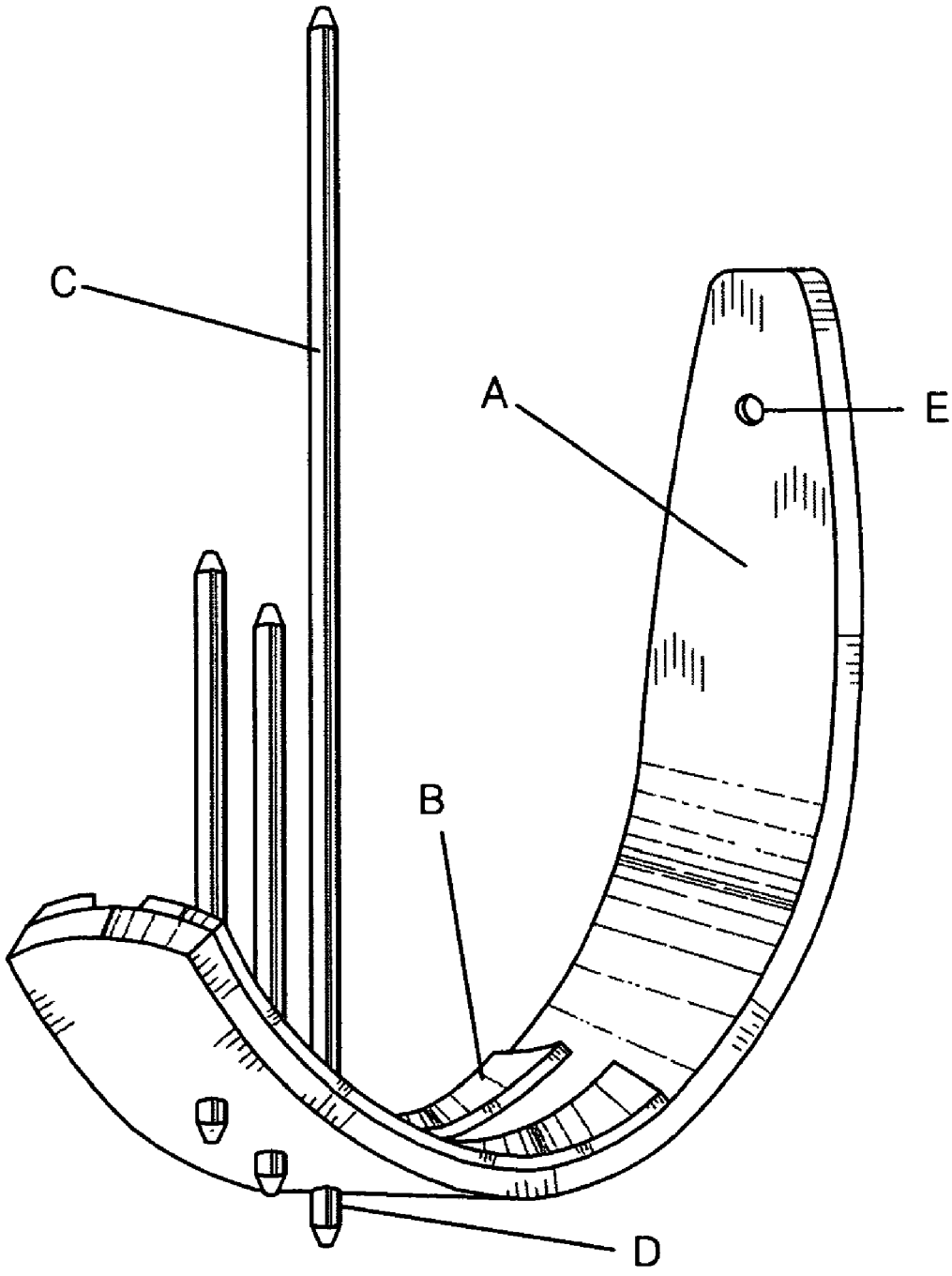
FIG. 1 is a perspective view of the main element of a wall-mountable J-shaped hanger (A) with padding (B) in the curved leg portion of the J-shaped hook with the unique and novel feature of one or more angled or straight peg-holes (D), provided anywhere through the entire length of the J-shaped member thereby allowing for pegs, referred to as "board separators" (C), of different sizes to be inserted as a mechanism for separating objects, the holding in place of objects and anti-slippage of these objects. A mounting hole (E) is shown on the straight leg portion of the improved J-shaped hook to allow for the different types of mounting hardware to secure the hanger to a wall, surface or other item—more than one mounting hole may be provided. The padding (B) is to support and protect the different types of boards, add-ons, objects and board accessories that will be resting in the curved portion of the J-shaped support leg.
Figure 3:
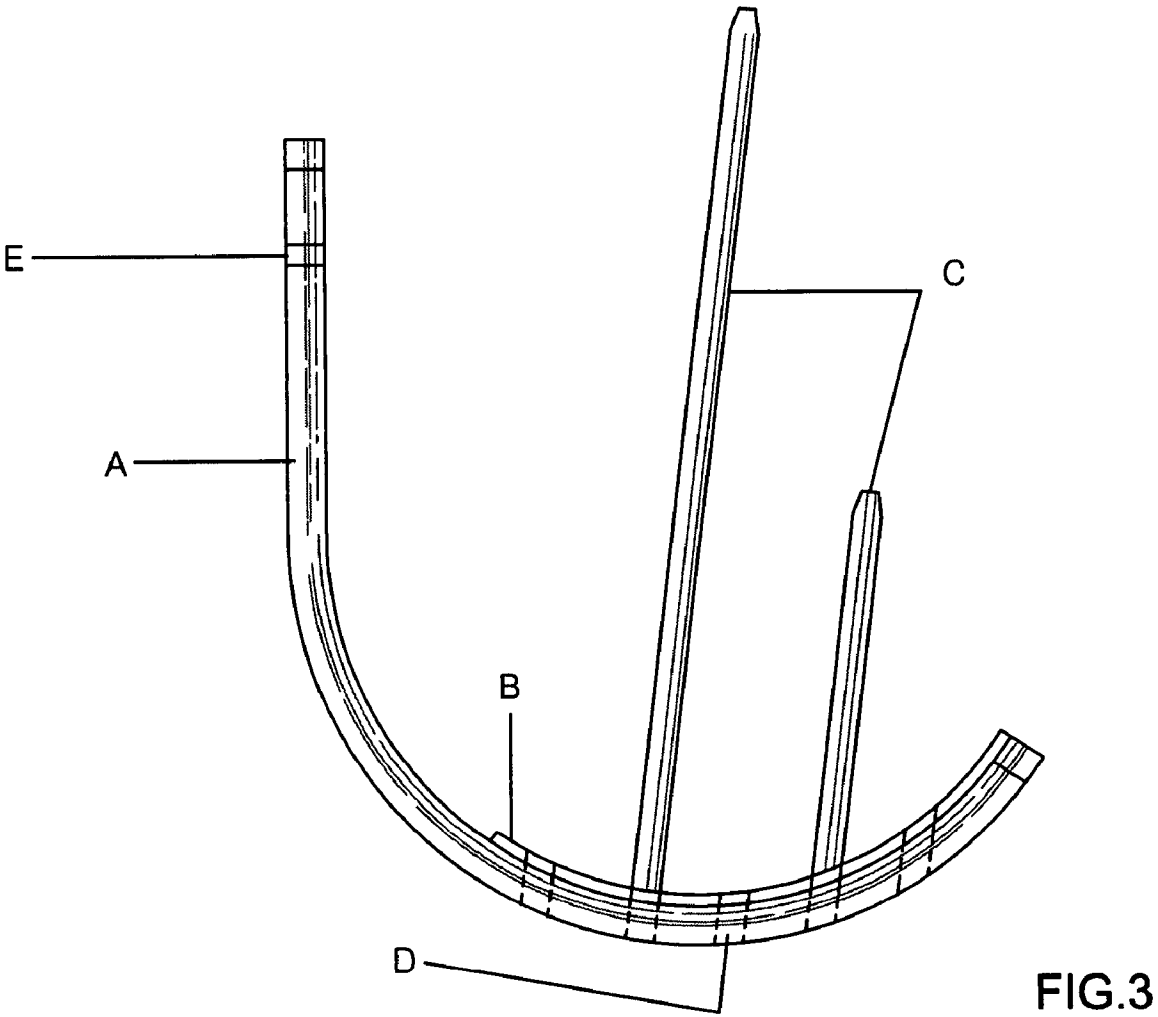
FIG. 3 is a side view of a hanger (A) with the "board separators" (C) in place between the padding (B) indicating the angled nature of the holes as an improvement to the J-shaped design allowing for more versatility in its intended use to hold objects securely away from the wall and separated from each other.
Figure 2:
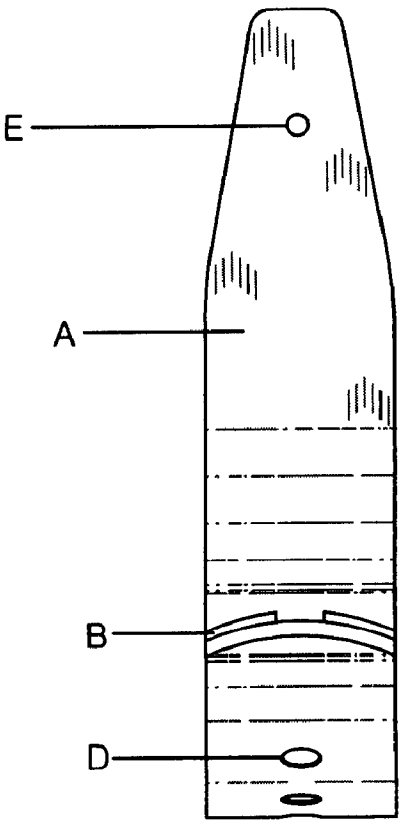
FIG. 2 is front view of this hanger showing the J-shaped hook (A), the protective padding (B) and the mounting hole (E) as well as the peg-holes (D) used for the placement of the "board separators" (C) (not shown here).
Figure 4:
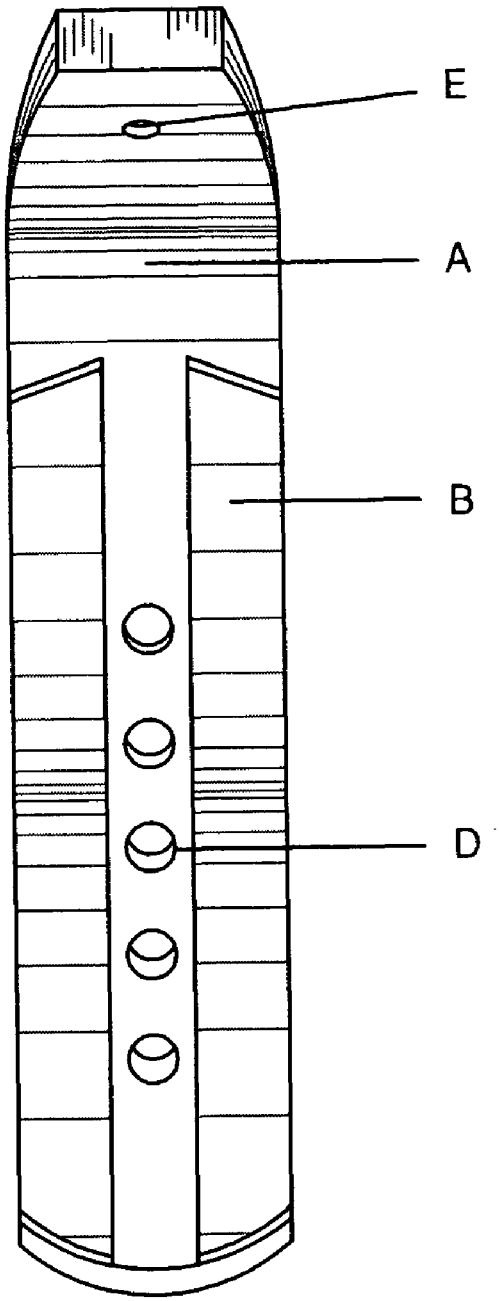
FIG. 4 is an elevation perspective of a hanger (A) indicating angled peg-holes (D) and one non-angled (straight) hardware-mounting hole (E).
Figure 5:
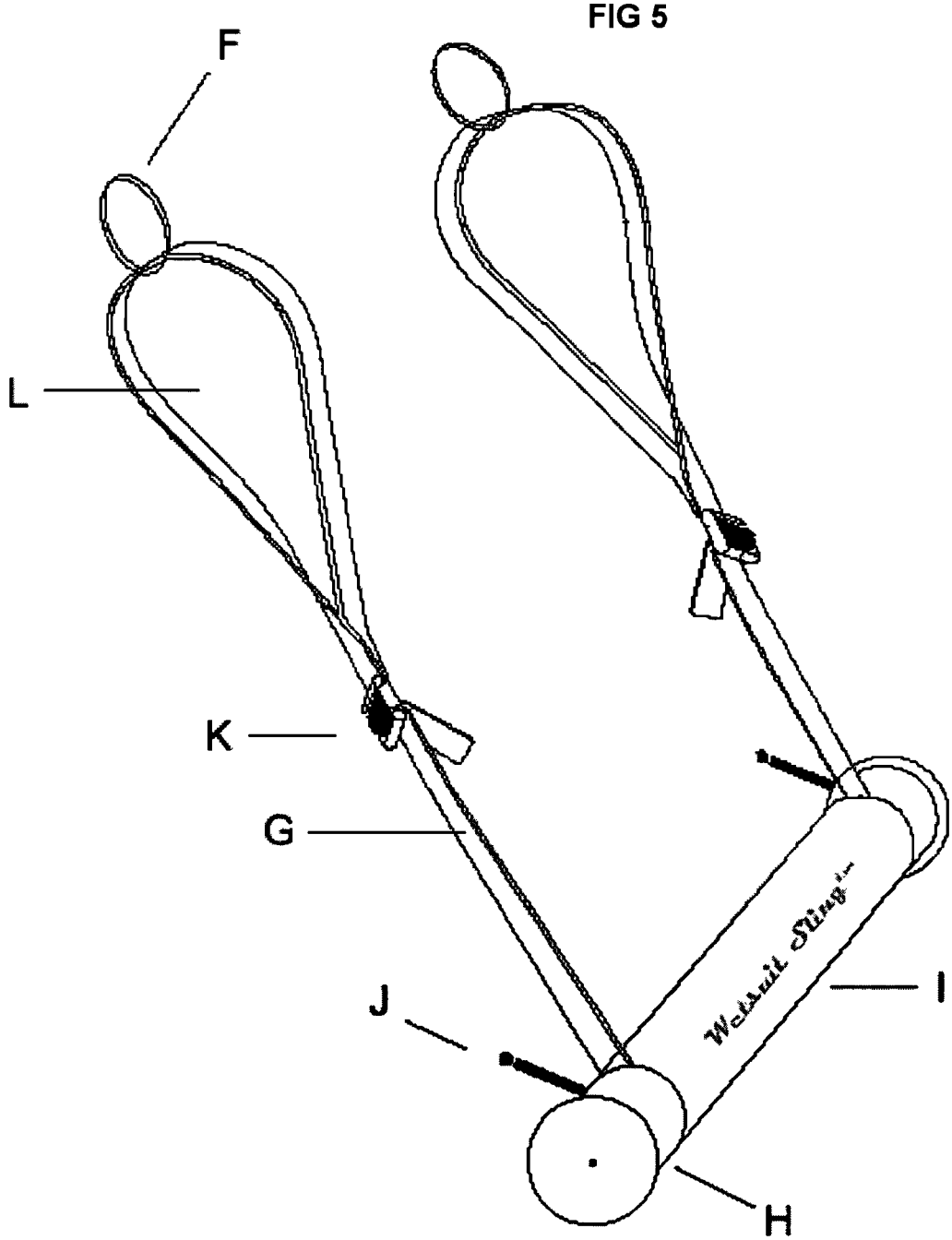
FIG. 5 is a perspective view of one of the parts of the UNIVERSAL HANGING SYSTEM referred to as the "Wetsuit Sling™" showing its labeled components of a pair of removable rings (F) attached to the adjustable looped strapping (G) that is either wrapped around or inserted through the rod component (I) and is secured with the removable end caps (H) that act as strap holders to keep the adjustable straps in place, with the end caps locked into position by the "wall separator" pegs (J). The adjustable slider type buckle (K) allows for the use of extra strapping configured in each loop at the end of the single piece of strapping which allows the user greater flexibility for choices of storage locations either with the modified J-shaped hanger of in the bathroom, garage or other user friendly drying location.
Figure 6:
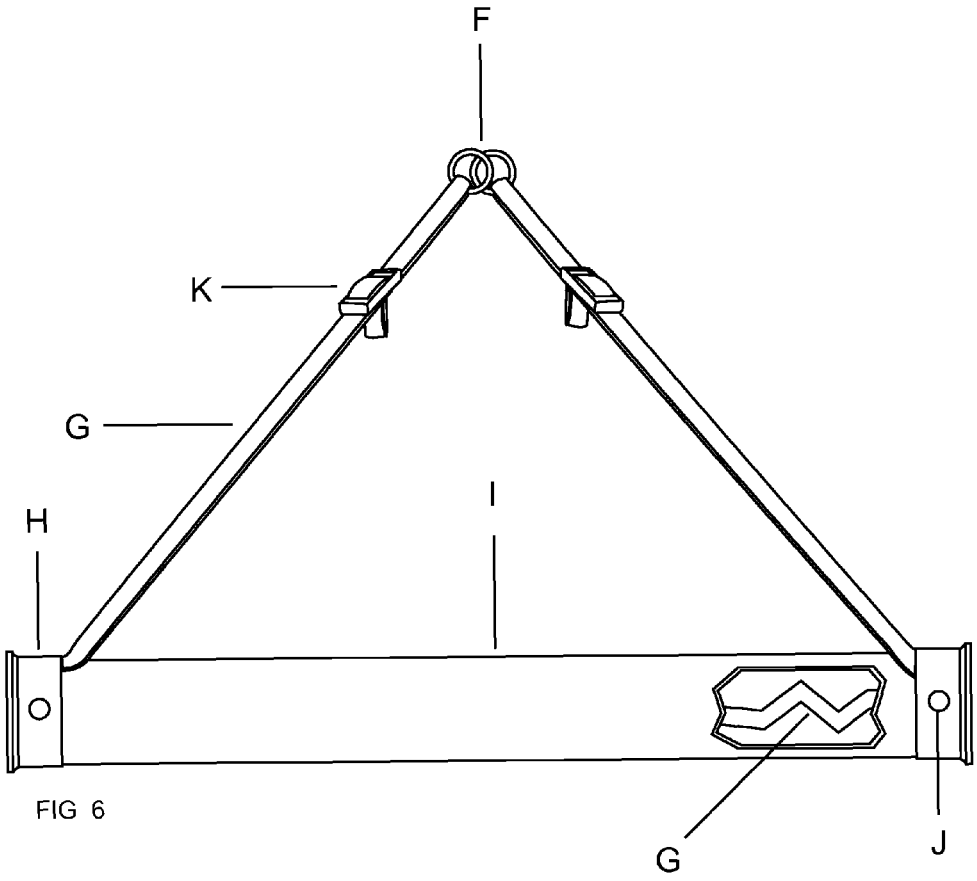
FIG. 6. is a perspective from the back of the Wetsuit Sling™ with a cut away view showing the storage of the extra adjustable strapping (G) stored within a hollow type rod with the end caps (H) locked into place with the "wall separator" pegs (J) shown head-on in their inserted position holding the strapping (G) in an almost fully extended configuration with the adjustable slider type buckle (K) close to the removable rings (F).
Figure 7:
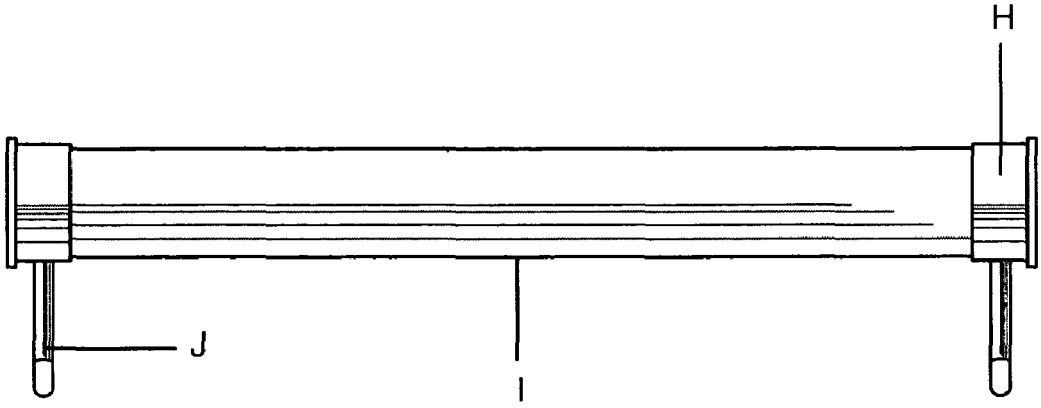
FIG. 7 is a top perspective of the removable and adjustable Wetsuit Sling™ showing the removable end cap (H) held in the secured holding position by the "wall separator" pegs (J).
Figure 8:
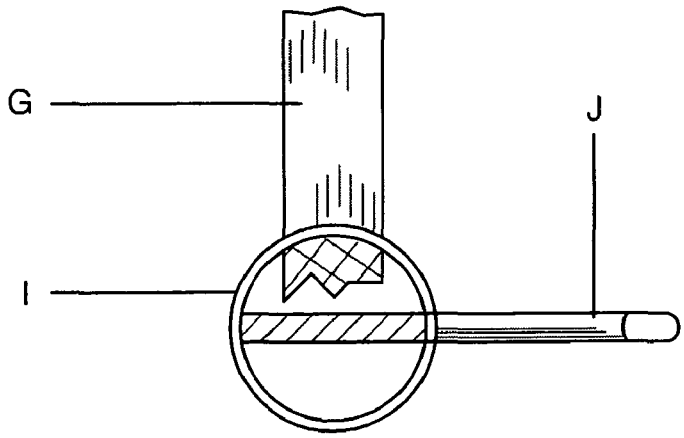
FIG. 8 is a side perspective of the Wetsuit Sling™ component showing the extension of the "wall separator" peg (J) inside a hollow type rod (I) using the interior wall of the rod as support.
Figure 9:
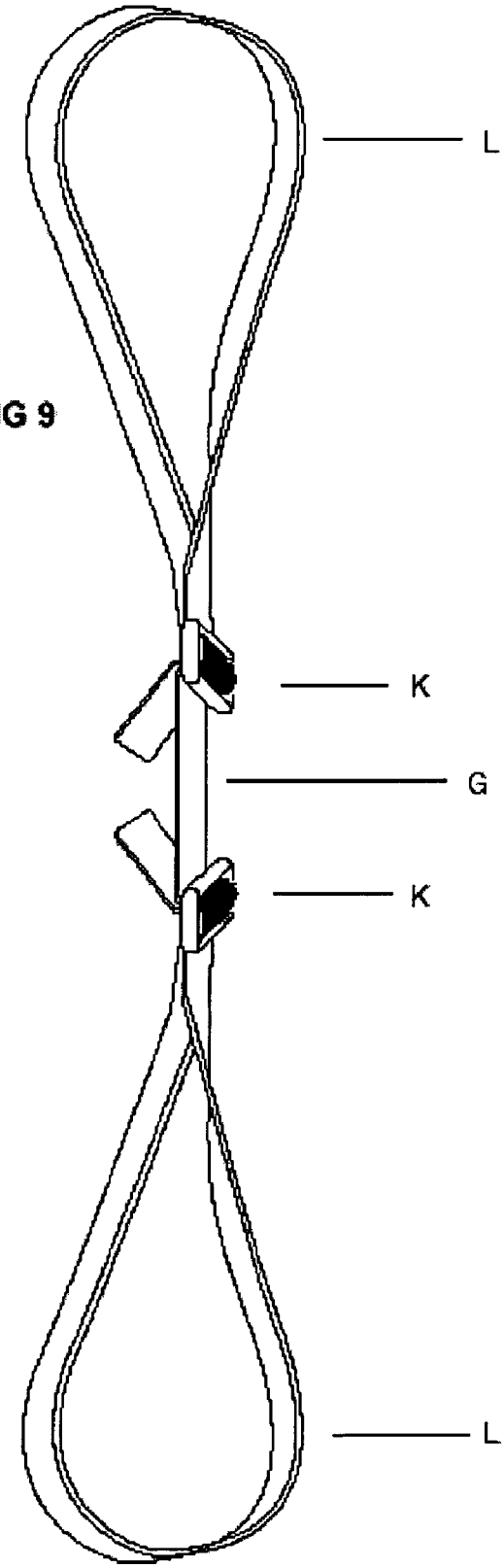
FIG. 9 is a perspective view of a third removable and adjustable component of the UNIVERSAL HANGING SYSTEM referred to as the "gear strap" that is a single piece of strapping (G) with an interchangeable adjustable loop (L) at each end configured with the slide-type strap adjuster mechanism (K) which is used to hold various-shaped objects or board accessories, such as masts, booms, paddles, parasail, sail bags, helmets, life preservers, water floatation devices and wetsuits in one of the adjustable loops (L) suspended by the other loop (L) that is hung onto the curved portion of the improved J-shaped hook. In addition to the embodiments of the "gear strap" it can be used independently of the UNVERSAL HANGING SYSTEM to be employed with other types of hanging devices.
Figure 10:
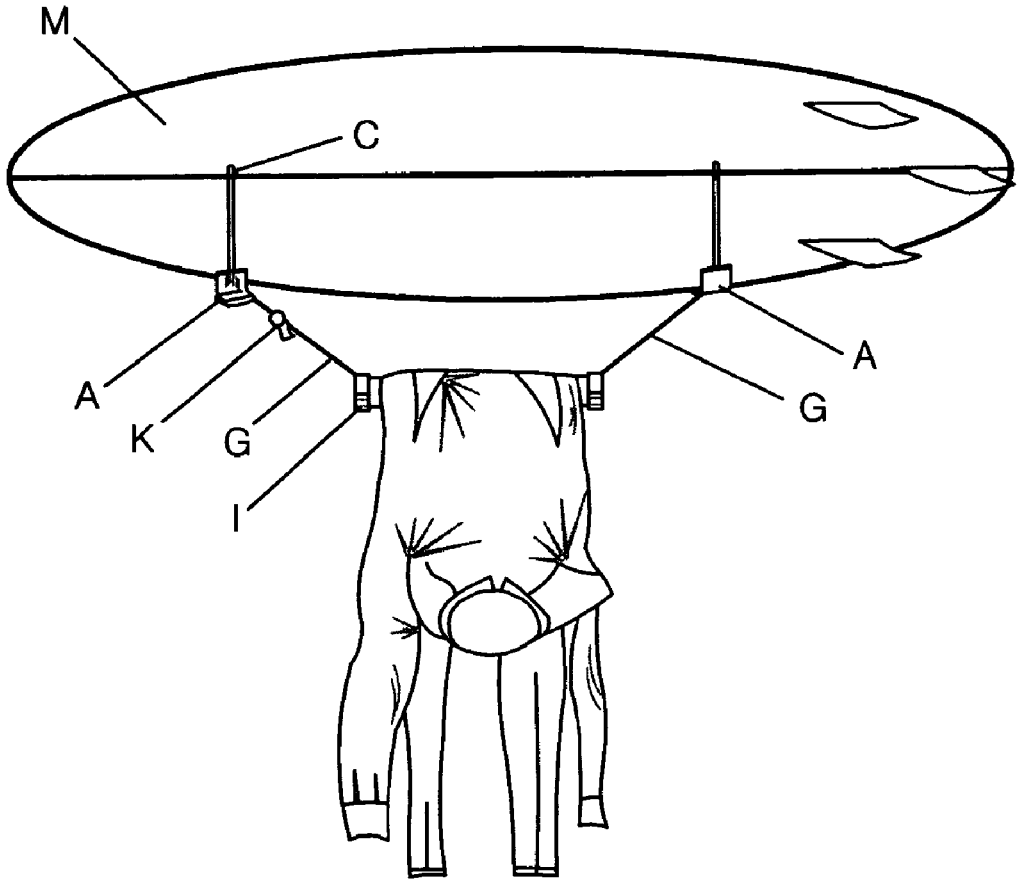
FIG. 10 is a front perspective drawing of the UNIVERSAL HANGING SYSTEM with a pair of hangers (A) holding a surfboard (M) in place using two of the component parts, a pair of "board separators" (C) and the novel use of a second component part the Wetsuit SlingTM (G, H, I & K) with adjustable straps (G) in an extended position being held in place by the end caps (H).
Figure 11:
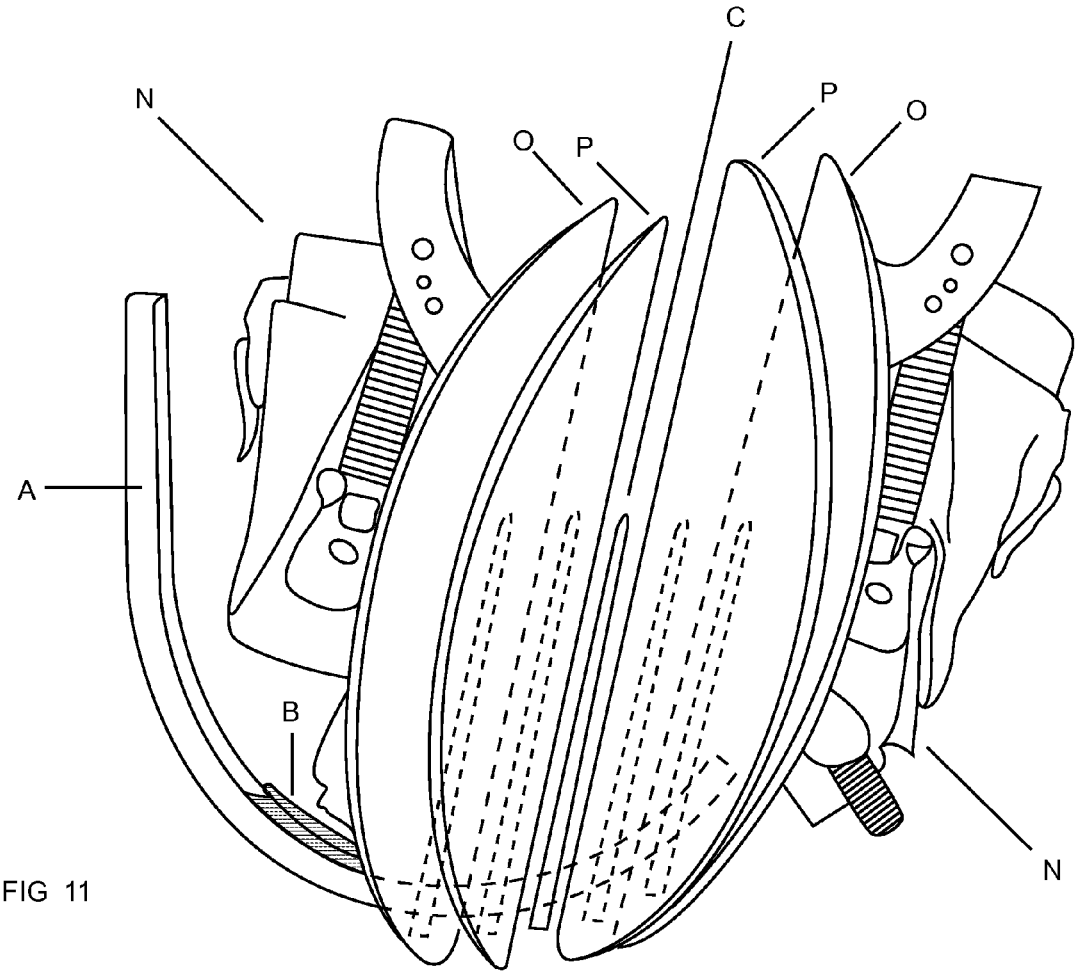
FIG. 11 is a side view of a pair of snowboards resting on the protective padding (B) of a hanger (A) using the "board separators" (C) to separate and hold in place the two snowboards (O) with bindings (N) and two plain snowboard decks without bindings (P). This unique and novel feature allows for the storage and display of several boards of different types while allowing for the bindings (N) to rest without touching the walls or other boards.
Figure 12:
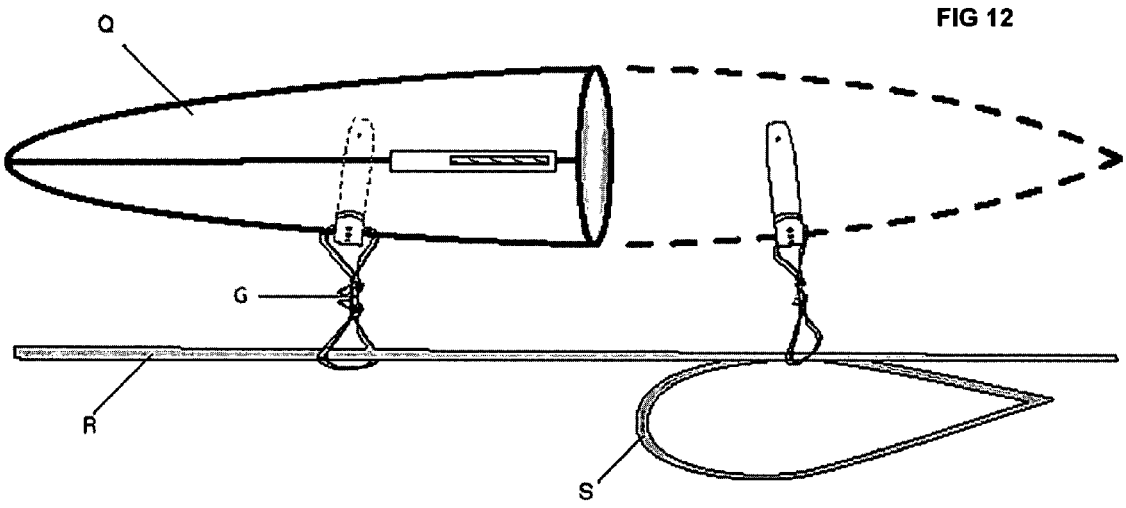
FIG. 12 is a front perspective of the UNIVERSAL HANGING SYSTEM holding a windsurfer (Q) (also know as a sail board) with all of its accessories using the adjustable "gear straps" (G) to hold two different accessories: the windsurfer mast (R) and its boom FIG. 12 (S).

It is, therefore, a primary object of the preferred embodiment of this present invention to provide a padded UNIVERSAL HANGING SYSTEM which is capable of supporting and storing a variety of differently sized and shaped objects and the component gear for each of the different objects, such as, but not limited to, surfboards, wakeboards, snowboards, skateboards, kite boards with parasail, sailboards with mast and sails, wind surfers, other board-types, skis, as well as street luge, small canoes, outriggers, kayaks, bicycles, cd's, wine, guitars and plants in one simple location for a safe and aesthetically pleasing manner for the purpose of display and/or storage either in the home, office or garage.

It is a further object of the present invention with its removable parts to allow for a multiple of different objects of different shapes and sizes to be stored together or singularly in a way that takes up less space and allow for the novel design of the invention to be mounted, as a pair or singularly, at any angle on the wall, thereby allowing for a variety of objects to be stored in a minimal amount of space with a variety of flexible storage solutions either horizontally or in a semi-vertical solution.

The wall mountable hanger is an improved modified J-shaped member having a rigid straight vertical leg that extends into a curved support leg having a padded arc anywhere between 90° and 270° degrees that can be made in a variety of diameters depending on the desired need, with the unique and novel feature of one or more angled or straight holes placed anywhere through the entire length of the J-shaped member, thereby allowing for one or more removable pegs of various lengths and appropriate diameter to be inserted as a mechanism for separating, holding in place and preventing slippage of the items stored. The specific improvement of adding these holes also allows for the addition of other "aftermarket" hardware (i.e., u-bolts, screws, modified threaded rods, metal wire, brackets and other hardware) to act as attaching mechanisms to secure other objects and devices to this improved J-shaped hanger. The padding protects the sides or rails of the different type boards as well as their accessories.

A related object of the present invention is to provide an easily modifiable system that can be further enhanced by the owner for adding more holes in different orientations for the benefit of adding more features such as, but not limited to, a wire, preferably coated with plastic or similar, strung across several of the J-shaped hooks for the storage of many boards across a wider expanse such as a ceiling, or as a means of adding other mounting holes to increase the weight-holding capability.

The J-shaped hooks can be constructed of easily obtainable materials such as wood, bent plys of wood, metal, bamboo, any type of plastic or resin or any other similar type building materials, but the range of potential materials is almost limitless.

Another object of the present invention is to provide removable and adjustable components such as "anti-slip/separator" pegs, a Wetsuit Sling™, "gear straps", skateboard strap, and a slip-on component sleeve that will accommodate pre-shaped accessory rods that can either directly hang from or be secured by hardware (e.g., screws, eyelets, L-brackets or U-bolts) to the J shaped hooks, and which will hold any of the different component gear and/or accessories that can be used with different sport boards and other items, like parasails, sails, masts, wetsuits, helmets, water floatation devices, life-jackets, ski-boots, ski poles, snow board boots, paddles, wine bottles, guitars, plants and other objects. This allows for a more flexible system with added features for storing a wider variety of objects together.

A related object of the present invention is the first of several removable component parts that is referred to as an "anti-slip/separator" peg, which can be of various varying lengths and diameters to fit into the corresponding holes on the J-shaped hanger to hold in place, prevent from slipping and separate different sized boards or objects. These pegs could be made of a wide variety of materials, such as wood, metal, plastic, bamboo or acrylic.

Another object of the present invention is to provide a second removable component that is an adjustable "Wetsuit Sling™" to dry and store a wetsuit, personal floatation device, life jacket, helmet, rash guard or booties or other items on the UNIVERSAL HANGING SYSTEM or anywhere that is convenient. The "Wetsuit Sling™" consists of three basic components: a main member referred to as the "rod", pegs or other devices called "wall separators" attached to the rod which maintain distance between the rod and a nearby item or surface such as a wall, and straps or other suspension or attachment device (ideally adjustable) attached to the rod.

Adjustable straps can allow the Wetsuit Sling™ to be attached to or suspended from the J-shaped hanger, or it can be separately suspended or attached, for example in a bathroom. Adjustable straps with removable rings permit attachment to the piping behind the shower head, or a nail, clothesline, wire, cord, hook or any other suspension or attachment point. The straps or other suspension or attachment device can be attached to the rod in a variety of ways, with the depicted preferred embodiment showing straps attached to the rod via removable end caps that act as the holding and adjusting mechanism. The strapping can be made from a variety of materials such as but not limited to nylon, polypropylene, rope, bungee cord, wire, synthetic, or natural fibers; in this particular depiction it is a single adjustable length with loops on each end that can be inserted thru or wrapped around the rod and held in place by the removable end caps, which in turn are secured in place by the wall separator pegs.

Removable rings or similar devices affixed to the ends of the strap(s) allow for flexibility in hanging the Wetsuit Sling™, for example from a nail or hook, onto any object with a projecting type lip or the present embodiment of J-shaped hook. The rings can be made from a variety of materials.

The Wetsuit Sling™ rod and end cap, which can be solid or hollow, as well as a variety of shapes, such as but not limited to circular, oval, square, trapezoidal or triangular, is of sufficient diameter to allow for the passage of air to circulate around and between a wetsuit's upper and lower halves when the suit is hung folded over the rod. By folding the wetsuit over the Wetsuit Sling™ into separate parts the wet materials drain from two locations simultaneously and combined with the circulating air accelerates the drying time for the wet materials. The rod can be made from a wide variety of materials, such as, but not limited to, plastic, pvc-pipe, metal, resin, bamboo, ceramic, wood, or any easily extruded material that either comes naturally or can be man-made.

Another component of the Wetsuit Sling™ is one hole near either edge of the Wetsuit Sling™ rod that goes partially thru the rod and end cap material in the same location to allow for the placement of a peg to distance the Wetsuit Sling™ from the wall, thereby allowing more air to circulate around the wet materials being stored on the Wetsuit Sling™. A further embodiment of the peg and its partial insertion into the rod component is as a locking mechanism for the removable end caps. The peg can be made as an example from a variety materials, such as, but not limited to, plastic, pvc-pipe, metal, resin, bamboo, ceramic, wood, or any easily extruded material that either comes naturally or can be man-made.

A further embodiment of the Wetsuit Sling™ rod can allow for it to be configured into different lengths to hold and separate one or multiple wetsuits lying in tandem or in a ladder-effect, which can be obtained by attaching the Wetsuit Sling™ to, or suspending it from, a second Wetsuit Sling™.

A corollary object of the present invention is to provide a third removable component, namely an adjustable "gear strap" configured of a single piece of strapping or similar with one loop arranged on each end by an overlapping end of the strap engaging a midsection of the strap by an adjustable means, such as a belt-type strap adjuster or adjustable slider mechanism, to create an adjustable size loop on each end thereby allowing flexibility to store different shaped objects and/or board accessories such as, but not limited to, booms, masts, sails, sail bags, parachutes, wake board kites, personal flotation devices, life preservers, helmets, parachute bags, para-foils or wing type sails, para-foils or wing type sail bags, paddles, wetsuits, or any of the various accessories that go with today's extreme style boards, or a wide variety of other items. The double-looped strapping can be made of a wide variety of materials such as, but not limited to, nylon, polypropylene, synthetic cord, natural rope, natural or synthetic fibers, bungee cord, fishing line and any type of fabric that can be hung from the improved J-shaped hook, or can be attached by available commercial hardware, which will hold the additional accessories that come with today's different "sport boards".

A further advantage of the present invention is that it provides a fourth removable component that is referred to as the "skateboard strap", configured of a single piece of strapping or similar with one loop arranged on each end by an overlapping end of the strap engaging a midsection of the strap by an adjustable means, such as a belt-type strap adjuster or adjustable slider mechanism with a hook inserted thru the loops to create a free-hanging pair of hooks to hold the axle of the truck mechanism of the skateboard thereby allowing it to hang onto the present embodiment of the J-shaped hanger.

In brief, a pair of spaced apart wall-mountable padded hooks with removable component parts to allow the boards and the additional gear that come with them to rest in and below the padded hooks in a safer all-in-one wall display/storage solution.

An advantage of the present invention is that it presents a certain flexibility in that you can separate the hangers and hang them at safe angles apart that allows for the storage of boards individually in a "semi-vertical" position to allow for a third storage solution already built into one system. While the J-shaped hangers can be secured to a wall, pole or other surface rigidly and by multiple attaching devices, such as screws, normally mounted through holes in the "top" of the "J", it can be particularly advantageous to attach the J-shaped hangers by a single screw (or other attaching device) each, and not quite tightly; this permits the J-shaped hangers to rotate, which is helpful for example in allowing them to best cradle the curvature at the ends of surfboards, or to switch from horizontal storage to the "semi-vertical" storage mentioned just above.

A further advantage of the present invention is that it provides an attractive display means for showing boards for sale in a manner that is more aesthetically pleasing and easily incorporated into homes, offices or garages than the existing devices.

It is understood that the preceding description is given merely by way of illustration and not in limitation of the invention and that various modifications may be made thereto without departing from the spirit of the invention as claimed.

I claim:

1. A support system for sportboards and other articles comprising two or more support members, with each said support member comprising a first, substantially vertical portion, for attachment to a vertical wall or other vertical support, and a second portion extending away from said wall or other support, the second portion having a free distal end and being essentially curved along its length such that each of the support members describe a "J" shape, for the support of sportboards and other articles across said support members, said second portion having one or more upward-facing openings, said openings being formed to accept adjustable separation pegs at an angle substantially perpendicular to the support member, said separation pegs serving to separate the supported articles from each other on opposite sides of and between the separation pegs and to support them in various configurations and separations.

2. The support system of claim 1, further comprising a drying system for drying wet articles, said drying system comprising a longitudinal member of which at least the upper portion is substantially semi-circular in cross-section, said member being supported by hanging means attached to the support member or members at one end of the hanging means and further attached to each end of the longitudinal member, said longitudinal member being further equipped at either end with spacing devices mounted at substantially right angles to both the member and its hanging means, said spacing devices being for the purpose of maintaining distance between said member and an adjacent surface.

3. The support system of claim 2, wherein the longitudinal member of the drying system is a hollow tube capable of storing said hanging means, said longitudinal member being further equipped with snug-fitting end caps which, by being slipped over an end of said longitudinal member with said hanging means protruding from it, can secure said hanging means to said longitudinal member; and wherein said spacing device fits snugly into a hole provided through a side of said end cap and into a side of said longitudinal member, thereby locking said end cap to said longitudinal member.

* * * * *